US007715734B2

(12) United States Patent
Edwards et al.

(10) Patent No.: US 7,715,734 B2
(45) Date of Patent: May 11, 2010

(54) PAPER CHANGE DETECTION METHOD

(75) Inventors: Mark Joseph Edwards, Lexington, KY (US); Charles Jarratt Simpson, Lexington, KY (US); Robert Edward Stoss, Lexington, KY (US); Sogra Nishath, Raleigh, NC (US)

(73) Assignee: Lexmark International, Inc., Lexington, KY (US)

( * ) Notice: Subject to any disclaimer, the term of this patent is extended or adjusted under 35 U.S.C. 154(b) by 241 days.

(21) Appl. No.: 11/839,150

(22) Filed: Aug. 15, 2007

(65) Prior Publication Data

US 2009/0045565 A1 Feb. 19, 2009

(51) Int. Cl.
*G03G 15/00* (2006.01)

(52) U.S. Cl. ..... 399/16; 399/23

(58) Field of Classification Search ..... 399/9, 399/16, 18, 21, 23, 75, 81; 400/582, 605; 271/265.01

See application file for complete search history.

(56) References Cited

U.S. PATENT DOCUMENTS

| | | | | |
|---|---|---|---|---|
| 6,255,665 | B1 | 7/2001 | Elgee et al. | |
| 6,325,505 | B1 | 12/2001 | Walker | |
| 6,364,556 | B1 | 4/2002 | Barbera et al. | |
| 6,817,794 | B2 * | 11/2004 | Kakutani | 400/582 |
| 6,978,114 | B2 * | 12/2005 | Okamoto et al. | 399/389 |
| 7,018,121 | B2 | 3/2006 | Barry et al. | |
| 7,436,532 | B2 * | 10/2008 | Tsujimoto | 358/1.15 |

* cited by examiner

*Primary Examiner*—Hoan H Tran

(57) ABSTRACT

A method for detecting a media change includes the steps of comparing a previous media condition to a current media condition, detecting a media change when the previous media condition is in one state and the current media condition is not that one state and, prompting a user to make appropriate menu selections when the media change is detected.

19 Claims, 7 Drawing Sheets

PAPER CHANGE DETECTION METHOD

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to media feeding and more specifically a method of detecting a media change and prompting a user to verify characteristics of the changed media.

2. Description of the Related Art

Image-forming devices are known for producing images on media such as plain paper, photo paper, transparencies and the like. Image-forming devices include laser printers, ink jet printers, and other types of printing peripherals that may include devices, such as a multi-function peripheral device or all-in-one device. In such an image-forming device or peripheral, media is positioned on an input tray and fed from the input tray through the printing device along a feedpath to an output tray. In general, the image-forming mechanism of the device, such as an ink jet printing mechanism, moves in a direction substantially perpendicular to the movement of the media through the media feedpath. However, the image-forming mechanism may alternatively be stationary relative to the media moving past the image forming portion of the device.

In low-cost peripheral devices, media changes between print jobs are typically not recognized. As media-type sensors have been introduced into these printing systems, the media-type may be detected at the beginning of a print job. However, these systems still rely on a user to actuate a menu and manually change the media size so that the print controller may properly determine the layout of the image being printed on to media. For example, if the media size is not changed within the menu system, a printer may continue printing when media has already passed through the print zone due to a change in media size. This causes ink spray on to the mechanisms and components adjacent the print mechanism and may result in ink smearing on later prints. Alternatively, if media-type is changed and not compensated for by the controller, the image quality may suffer significantly. This is because controllers are generally calibrated to eject ink in different ways for different media-types.

It would be helpful to a user if the printing peripheral recognized a media change and affirmatively prompted a user to verify media characteristics located within the input tray of the feedpath.

SUMMARY OF THE INVENTION

A method of paper change detection comprises querying a media sensor a first time, defining a first current media condition, defining the first current media condition as a previous media condition, querying the media sensor a second time, defining a second current media condition, comparing the previous media condition to the second current media condition, detecting a media change when the previous media condition is empty and the second current media condition is not empty, and, prompting a user to make appropriate menu selections when the media change is detected. The method further comprises detecting the media change in a first media polling process loop and prompting the user in a second printer operation and display process loop. The method further comprises setting a current paper out latch or a previous paper out latch for the current media condition and the previous media condition. The method further comprises moving through a menu to reset the media conditions when the media is empty or the media is changed. The sensor detects at least one of media-type and paper out condition.

A method of media change detection comprises querying a media sensor for media-type, defining a first current media-type, defining the first current media-type as a previous media-type, querying the media sensor for a second current media-type, defining a second current media-type, comparing the second current media-type to the previous media-type, detecting a media-type change when the previous media-type differs from the second current media-type, and prompting a user to make at least one appropriate menu selection regarding the media-type change. The media sensor detects at least one of media-type and media out condition. The method further comprises determining whether the printer is idle. The method further comprises displaying a load paper message when the media sensor determines no media-type is present. The method further comprises making at least one selection when additional media is loaded.

A method of detecting media change along a media feedpath of a peripheral comprises querying a media sensor for a first media-type, querying the media sensor a second time for a second media-type, determining whether the first media-type differs from the second media-type, and prompting a user to make at least one selection when the second media-type changes from the first media-type. The media sensor may detect multiple types of media present or, alternatively, the media sensor may detect media empty condition. The method further determines if the first media-type indicates media empty and the second media-type indicates media present. It also determines if the first media-type indicates media present and the second media-type indicates media empty. The method further comprises displaying a media change detection on a menu. The method further comprises directing a user to verify the media change after being prompted. The method further comprises directing a user to load media when the tray is empty. The method further comprises querying the media sensor repeatedly while the peripheral is powered on. The method further comprises utilizing a second process loop to analyze indicators of a first process loop.

A method of detecting a media change comprises the steps of comparing a previous media condition to a current media condition, detecting a media change when the previous media condition is in one state and the current media condition is not in said one state and, prompting a user to make appropriate menu selections when the media change is detected.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
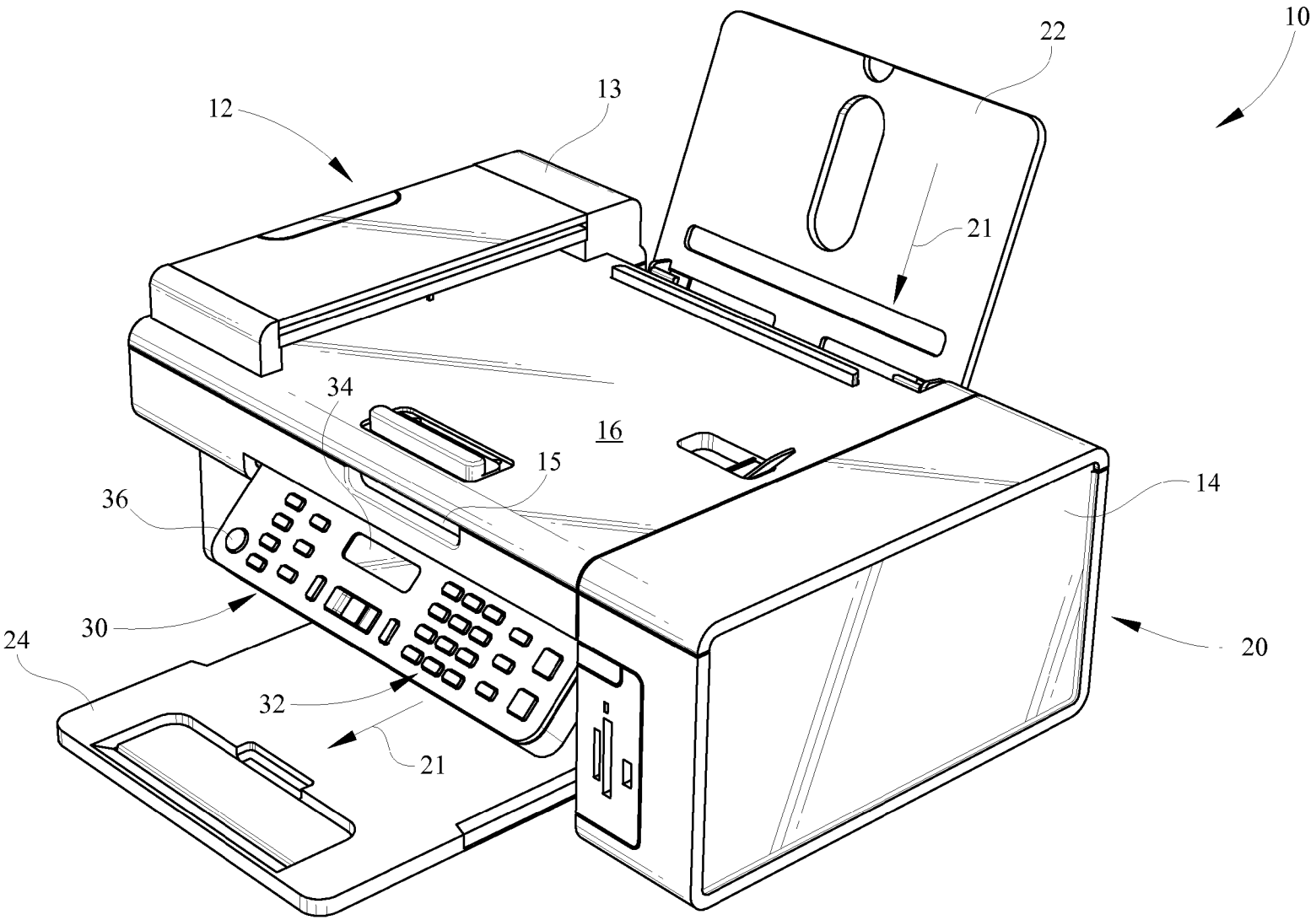
FIG. 1 is a perspective view of an all-in-one peripheral including a printing mechanism.

The following description and drawings illustrate embodiments of the invention sufficiently to enable those skilled in the art to practice it. It is to be understood that the invention is not limited in its application to the steps of the method, the details of construction and the arrangement of components set forth in the following description or illustrated in the drawings. The invention is capable of other embodiments and of being practiced or of being carried out in various ways. For example, other embodiments may incorporate structural, chronological, electrical, process, and other changes. Examples merely typify possible variations. Individual components and functions are optional unless explicitly required, and the sequence of operations may vary. Portions and features of some embodiment may be included in or substituted for those of others. The scope of the invention encompasses the appended claims and all available equivalents. The following description is, therefore, not to be taken in a limited sense, and the scope of the present invention as defined by the appended claims.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

The term image as used herein encompasses any printed or digital form of text, graphic, or combination thereof. The term output as used herein encompasses output from any printing device such as color and black-and-white copiers, color and black-and-white printers, and so-called "all-in-one devices" that incorporate two or more functions such as scanning, copying, printing, and faxing capabilities in one device. Such printing devices may utilize ink jet, dot matrix, dye sublimation, laser, and any other suitable print formats. The term button as used herein means any component, whether a physical component or graphic user interface icon, that is engaged to initiate output. The term latch as used herein means a flag, cell, value, variable or other such indicator which may be sent to a specific location in the firmware and utilized to signal the controller. The term media and paper are used interchangeably herein and may include plain paper, photo paper, card stock, transparency, Mylar, fabric, or other printable materials.

Referring now in detail to the drawings, wherein like numerals indicate like elements throughout the several views, there are shown in FIGS. 1-7 various aspects of an all-in-one device which utilizes a paper change detection method. The all-in-one device employees processes or loops that repeatedly poll or query a media sensor and compares previous and current outputs to determine when conditions change in a manner requiring user prompting to verify that a media change has occurred. In the depicted embodiments, indicators may be generated by one loop and analyzed by a second loop or process. However, it is within the scope of the present invention that a single loop or process perform the methods described herein, or that more than two loops or processes perform such method.

Referring initially to FIG. 1, an all-in-one peripheral device 10 is shown generally having a chassis (not shown) surrounded by a housing 14 which encompasses an upper scanner portion 12 and a lower printer portion 20. The all-in-one peripheral device 10 is shown and described herein, however one of ordinary skill in the art will understand upon reading of the instant specification that the present invention may be utilized with a stand alone printer, copier, scanner or other peripheral device which has a media feedpath and may be utilized with different sizes and types of media including, but not limited to, paper, card-stock, envelopes, fabric, transparencies, Mylar and the like. For convenience, the illustrative embodiment will describe paper as the print medium.

The device 10 may also comprise a controller 80 (FIG. 4), which may be a microprocessor, for receiving instructions from a personal computer or other such device and controlling various device components as well as conducting the methods described herein. The controller 80 also controls the various functions of the all-in-one device including printing, scanning, faxing, copying and other such functions of such a personal or commercially utilized peripheral device 10. The peripheral device 10 further comprises a control panel 30 having a plurality of buttons 32 for making command selections, verifying prompts or correcting error conditions, as will be described further herein. The control panel 30 may also comprise a display 34 for prompting a user, providing selection options, reporting error conditions, and the like. Alternatively, a light 36, such as an LED, may be utilized to indicate a variety of error conditions or prompts through a pattern of on-off changes. The control panel 30 may also utilize a numeric keypad for fax operations if such functionality is included in the all-in-one device 10. The control panel 30 provides an interface between users and the print controller 80 of device 10.

The scanner 12 includes a flatbed scanner and an auto-document feed (ADF) scanner 13. The flat bed scanner is generally represented by a lid 16 which is pivotally connected the chassis (not shown) or housing 14. The lid 16 is movable by grasping a handle 15 and lifting the lid 16. The lid 16 may also function as a tray for input and output of target documents into the ADF scanner 13. The following components are described generally as part of the scanner 12, but are not shown since they are generally known to one skilled in the art. A scan bar or scan head is slideably connected to a guide bar or rail. A drive mechanism is connected to the scan bar to move the scan bar along the guide bar in a scanning direction. A control ribbon cable provides power to the scan bar and allows transfer of both optical and control signals from the scan bar to the controller 80 within the peripheral device 10. The controller 80 also provides signals to a motor to move the scan bar via the transmission. The exemplary scan bar acquires an image from a target image or object by successively scanning line images of the object being scanned. Accordingly, the transmission moves the scan bar along the guide bar obtaining multiple line images of the target image. The scan bar, guide bar, drive mechanism and ribbon or data connector are all placed beneath the platen or scan glass of the scanbed upon which the target image or object is positioned for scanning. In use of the ADF scanner 13, the scanbar is positioned at a normal home position while media is fed over the stationary scanbar. In this manner, images may be obtained quickly and efficiently for media feeding documents suitable for such feeding.

The scan bar utilizes image acquiring components to capture each scan line during the sweeping motion beneath the platen. The scan bar is generally either an optical reduction type using a combination of lens, mirror and a CCD (Charge Coupled Device) array or CIS (Contact Image Sensors) array. The CCD array is a collection of tiny, light-sensitive diodes, which convert photons into electrons. These diodes are called photosites—the brighter the light that hits a single photosite, the greater the electrical charge that will accumulate at that site. The image of the document that is scanned using a light source such as a fluorescent bulb reaches the CCD array through a series of mirrors, filters and lenses. The exact configuration of these components will depend on the model of scanner. Some optical reduction scanners use a three pass scanning method. Each pass uses a different color filter (red, green or blue) between the lens and CCD array. After the three passes are completed, the scanner software assembles the three filtered images into a single full-color image. Most optical reduction scanners use the single pass method. The lens splits the image into three smaller versions of the original. Each smaller version passes through a color filter (either red, green or blue) onto a discrete section of the CCD array. The scanner software combines the data from the three parts of the CCD array into a single full-color image.

In general, for inexpensive flatbed scanners contact image sensors (CIS) are used in the scan bar. CIS arrays replace the CCD array, mirrors, filters, lamp and lens with an array of red, green and blue light emitting diodes (LEDs) and a corresponding array of phototransistors. The image sensor array consists of 600, 1200, 2400 or 4800 LEDs and phototransistors per inch (depending on resolution) spans the width of the scan area and is placed very close to the glass plate upon which rest the image to be scanned. Another version of the CIS used a single set of red, green and blue LEDs in combination with light pipes to provide illumination of the material to be scanned. When the image is scanned, the LEDs combine to provide a white light source. The illuminated image is then captured by the row of sensors. CIS scanners are cheaper, lighter and thinner, but may not provide the same level of quality and resolution found in most optical reduction scanners. Color scanning is done by illuminating each color type of LED separately and then combining the three scans.

Figure 2:
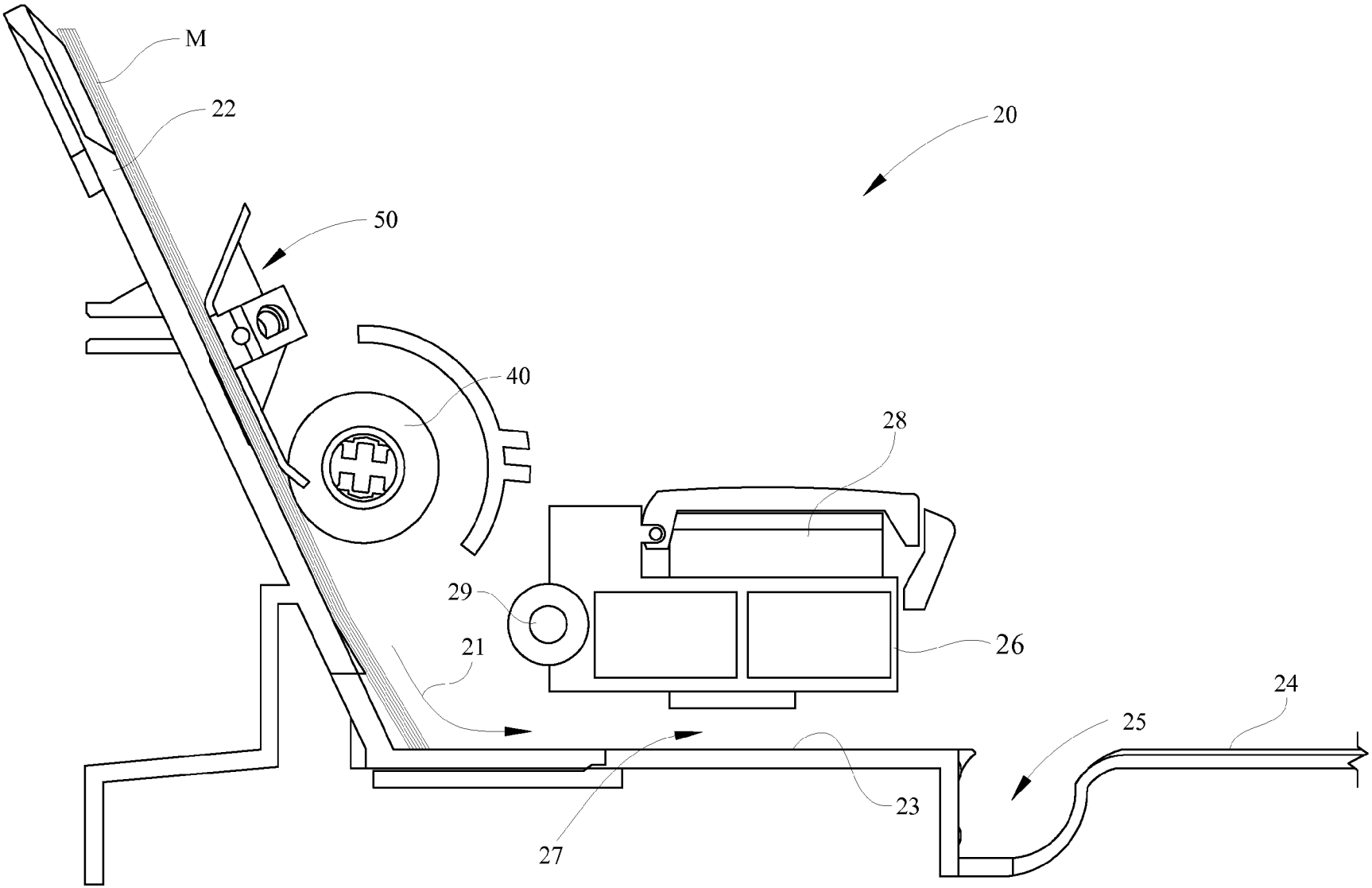
FIG. 2 is a side view of a print feedpath having a media sensor therein.

Referring now to FIGS. 1 and 2, and regarding the printer portion 20, extending from the rear of the device 10 is an input tray 22 for printing media. The input tray 22 is generally upright for feeding media (not shown) into the printer portion 20. At the front of the printer portion 20 is an output area 24 for retaining media after a print process. Alternative exemplary devices may only utilize a single tray however, depending on the feedpath configuration. The input tray 22 may be a rigid tray or alternatively may be slidably extended during printing or slidably retracted into a nested configuration when not in use. The input and output trays 22, 24 of the printer portion 20 define start and end positions respectively, of a media feedpath 21 (indicated by arrows) through the printer portion 20. One skilled in the art will understand that the media feedpath 21 illustrated is generally an L-shaped media feedpath due to the depicted configuration. However, it is within the scope of the present invention that a C-shaped media feedpath configuration or a straight-through feedpath may be utilized. The input tray 22 or the output tray 24 may retain a preselected number of sheets defining a stack of media (not shown) which will vary in thickness based on the media-type.

The printer portion 20 may include various types of printing mechanisms including dye-sublimation, dot-matrix, inkjet or laser printing. For ease of description, the exemplary printer portion 20 may be an inkjet printing device although such description should not be considered limiting. The printer portion 20 of the exemplary device 10 includes various components generally described but not shown. The printer portion 20 includes a carriage 26 having a position for placement of at least one print cartridge 28. According to the exemplary embodiment, two print cartridges may be utilized wherein, by way of example, a color cartridge is utilized for photos and a black cartridge is utilized for text or other monochrome printing. As one skilled in the art will recognize, the color cartridge may include three inks, i.e., cyan, magenta and yellow inks. Alternatively, in lower cost machines, a single cartridge may be utilized wherein the three inks, i.e., cyan, magenta and yellow inks are simultaneously utilized to provide the black for text printing or for photo printing. As a further alternative, a single black cartridge may be used. During advancement media moves from the input tray 22 to the output 24 along a substantially L-shaped media feedpath 21 beneath the carriage 26 and cartridges 28. As the media moves into a print zone 27 beneath the at least one ink cartridge 28, the media moves in a first direction along feedpath 21 and the carriage 26 and the cartridges 28 move in a second direction which is transverse to the movement of the media M. The controller 80 signals a motor (shown schematically in FIG. 4) which is connected to the carriage by a drive assembly. The motor may be a DC drive motor and the drive assembly and printer drive system may further comprise a position feedback system to communicate carriage position to the controller 80 during operation. For example, an optical encoder strip may be mounted to the carriage 26 to provide positional information provided by an encoder strip. The manner of providing positional feedback information may be accomplished in a variety of ways known to one skilled in the art. Such communication system may be an optical encoder. The drive assembly may include a gear or other type of transmission as well as an endless belt or cable (not shown) as understood by one skilled in the art. The carriage 26 is guided during this movement by a slide bar 29 extending between portions of and supported by the chassis. During this movement, ink is selectively ejected onto the media to form an image.

Figure 3:
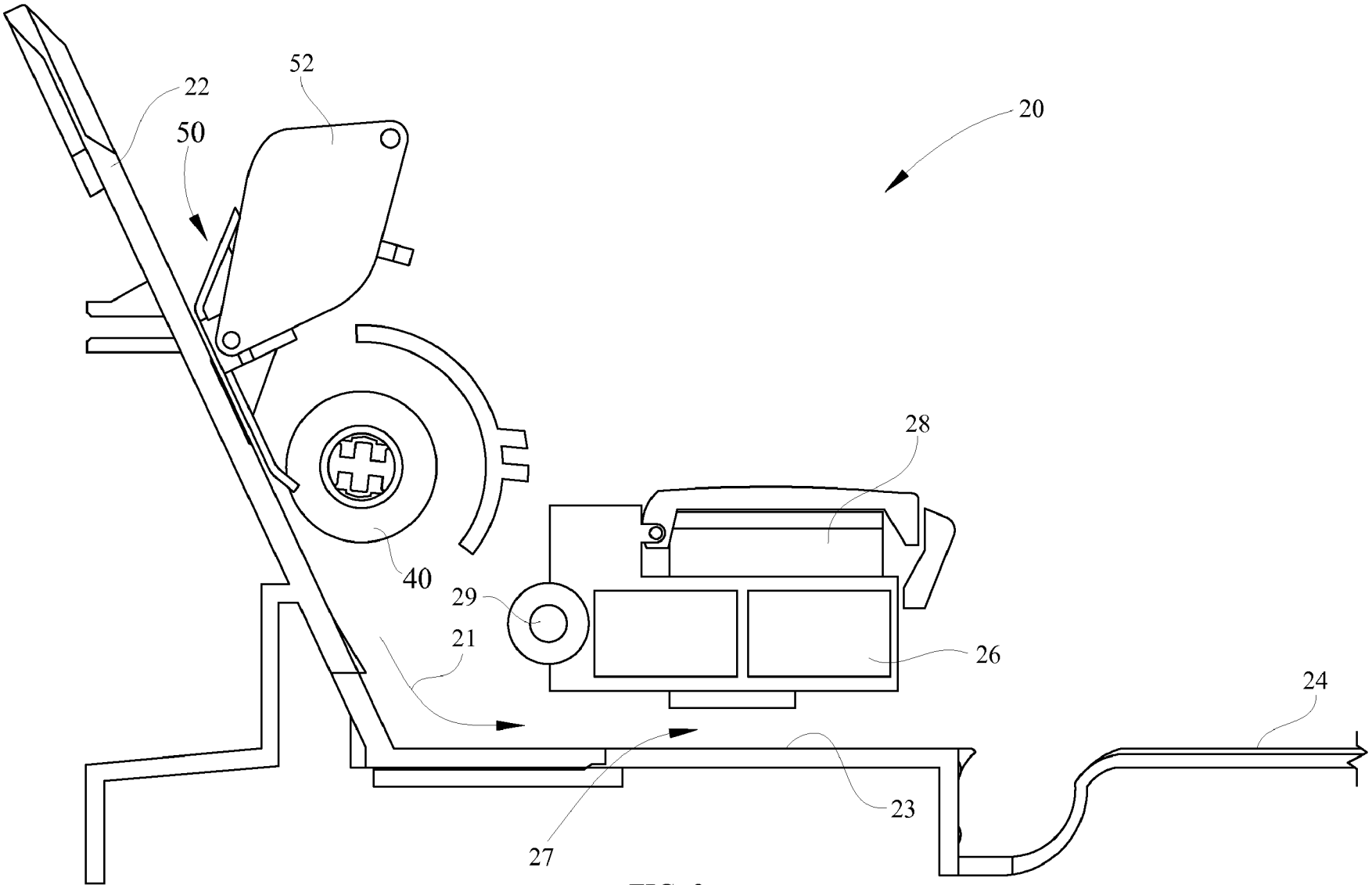
FIG. 3 is a side view of the feedpath of FIG. 2 including an arm for pivotal movement of the media sensor.
Figure 4:
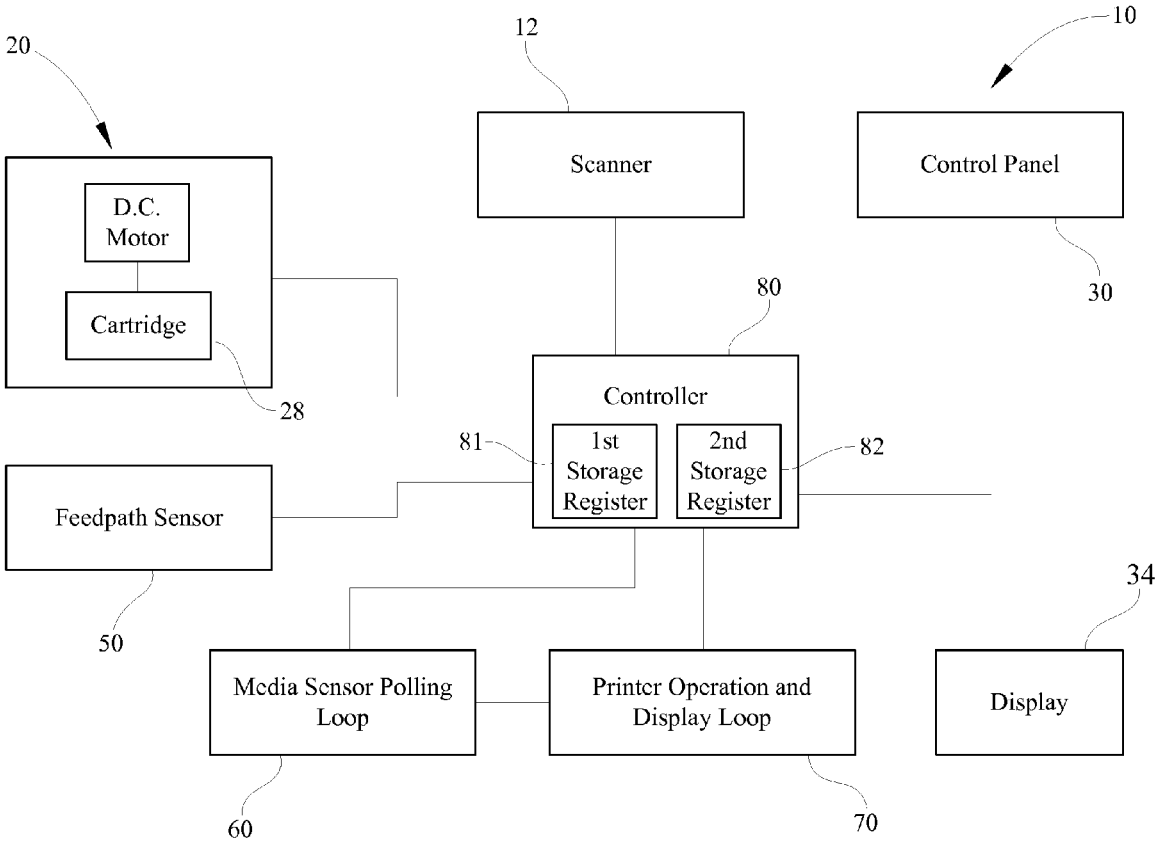
FIG. 4 is a schematic representation of the all-in-one device of FIG. 1.

Still referring to FIG. 2, the feedpath 21 is defined between the input tray 22 and the output tray 24. Also positioned along the feedpath 21 is a sensor 50 which, according to the present embodiment, may determine whether media is present and/or the media-type and may communicate such information to the controller 80 (FIG. 4). For example, the media sensor 50 may provide one of the following responses to the controller 80: plain paper, photo paper, transparency or paper out. A response of paper out indicates that the input tray 22 is empty. In general, the media sensor operates by utilizing a light source which generates a light beam. A detector portion is located near the light source in order to detect a diffuse light beam reflected from a media sheet. Additionally, the detector portion may have a reflector for directing specular components toward the diffuse detector in the absence of media. The media sensor 50 may swing into contact with the media and make a determination of either or both of the paper type or whether the media tray 22 is empty. A support mechanism 52 allowing the pivotal motion is depicted in FIG. 3. It should be understood, that the detection of the paper out condition does not need to be made by the media sensor 50. It may be performed by any sensor that detects when paper is absent or present from the various locations within the printer 20.

Also positioned along the feedpath 21 is a pick tire 40. When media M is positioned in the tray 22, the pick tire 40 feeds from the top of the media stack into the feedpath 21. Alternatively, a bottom feed pick system may be utilized. The pick tire 40 may be included in an auto-compensating mechanism, which is known to one skilled in the art, or may be positioned on a traditional roller-shaft arrangement wherein the shaft extends across the media tray 22 and includes one or more rollers 40 thereon to pick media from the media stack. As the media M moves through the feedpath 21, the cartridge 28 selectively ejects ink on the media M forming an image. A print zone 27 is defined between a mid-frame 23 and the cartridge 28 wherein media M passes. Along the feedpath 21 in the feeding direction and past the mid-frame 23, a roller housing 25 is depicted adjacent the exit tray 24.

Referring to FIG. 4, a schematic diagram of the all-in-one device 10 is depicted. The controller 80 may comprise a microprocessor for computing and controlling various components of the device 10. The controller 80 receives inputs, commands and signals from the various components of the device 10 and likewise provides commands to the various components of the device 10 for operation. The controller 80 may also run firmware either on-board the controller 80 or external thereto which conducts the methods herein. The controller 80 comprises a first storage register 81 and a second storage register 82. The storage registers 81,82 may be defined by memory on the controller 80 or be external to the controller 80. The first storage register 81 is utilized to record one of a "current media-type" and a "previous media-type" while the second storage register 82 may record the other of the "current media-type" and the "previous media-type." Additionally, the storage registers 81, 82 may be used to store flags, latches, values, variables or other indicators. Further, the storage may occur at other locations within the device 10 or within a host computer memory. The storage registers 81, 82 may be separate memory devices or may be a single memory device having locations for at least the current and previous media-type or condition recording. The controller 80 may also receive inputs from the control panel 30 for making selections, correcting error conditions, or changing an operating parameter. The controller 80 signals a user for selections or errors at display 34 and receives commands from selections made by a plurality of control buttons 32 or from a host computer (not shown), such as a personal computer, and accordingly operates appropriate components of the device 10, such as the printer 20, scanner 12 or the components described herein.

The schematic diagram also depicts various components of the device 10, including a scanner 12 in communication with the controller 80. The scanner 12 may represent one or both the flatbed type scanner and the ADF scanner 13 located on the peripheral 10. Further, the controller 80 is in data communication with the printer 20 to control the motor for media advancement and cartridge 28 movement.

The controller 80 is also in data communication with the feedpath sensor 50, which is located on the feedpath 21 within the input tray 22, in the exemplary embodiment. The feedpath sensor 50 may also be located at other positions along the feedpath to indicate either or both of media-type and media presence. In addition to the feedpath sensor 50, the media sensor polling loop 60 and printer operation and display loop 70 are in communication with the controller 80 as well as one another. According to one exemplary embodiment, the loops or processes 60, 70 are defined by firmware within the controller 80 or otherwise accessible by the controller 80. Generally, the first loop 60 generates indicators, flags, latches, variables, values or other conditions which are analyzed by the second loop 70, according to the exemplary embodiments. However, these loops may be consolidated into a single loop or three or more loops.

Figure 5:
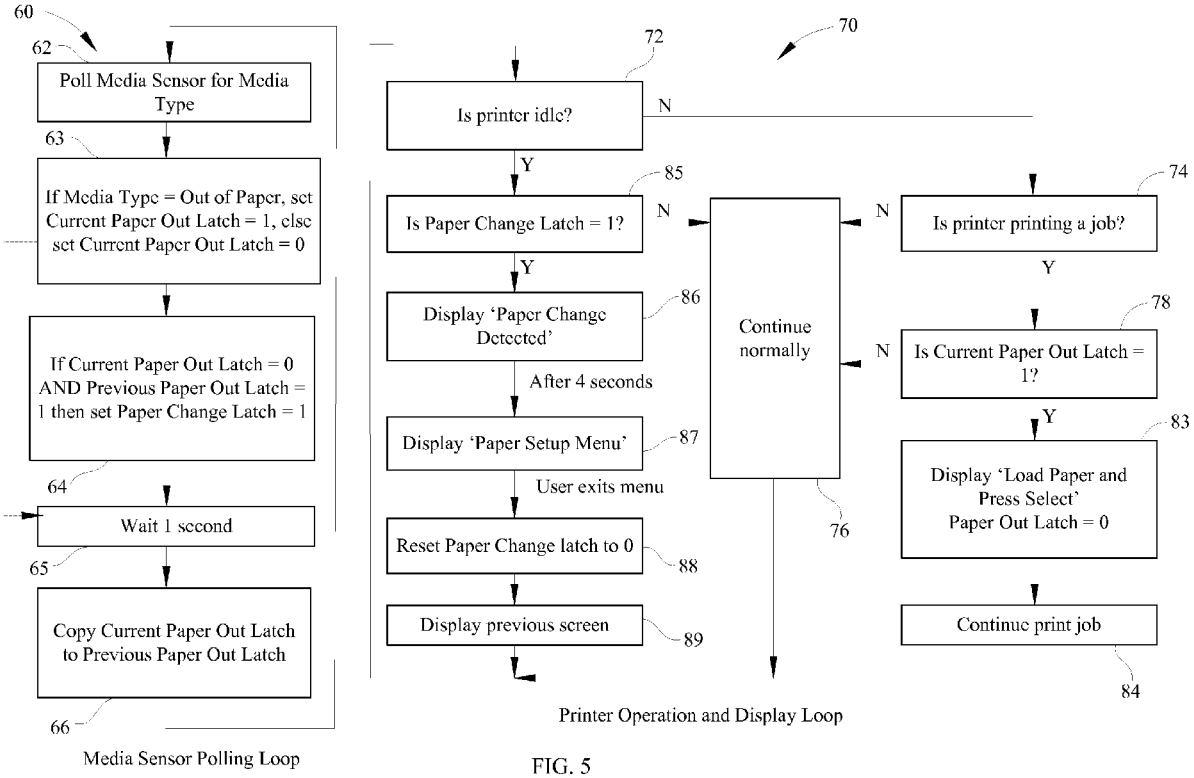
FIG. 5 is a flow chart depicting the method of detecting a media change.

Operation of the feedpath sensor 50, media sensor polling loop 60 and printer operation and display loop 70 are now described in reference to the flow chart shown in FIG. 5. On the left hand side of the flow chart, the media sensing polling loop 60 is depicted, which in general, continuously polls the media sensor 50 to determine what media-type is loaded into the media tray 22. In addition, according to the present embodiment, the media sensor 50 may also detect when media is not present. In a first step of the loop 60, the media-type sensor 50 is queried or polled at step 62 by the controller 80. The sensor 50 may record various media-types including, but not limited to, plain media, standard photo media, premium photo media, matted paper, coated media, transparency, and paper out, which indicates that the tray 22 or whatever location the sensor 50 is positioned is empty or that media is not present. Next, the result of the poll or query may be recorded or defined digitally in storage registers 81, 82 on memory within the controller 80 or elsewhere. For example, at step 63 if the sensor 50 indicates that tray 22 is out of paper, one of the first and second storage registers 81, 82 named as a current paper out latch may be set to one (1) or some preselected digital value. Or, if media is present then the current paper out latch may be set to zero (0) or some other preselected digital value. During an initial cycle, the loop 60 skips step 64 since two values are necessary. This is indicated by broken line. Next at step 65, the processor waits for a preselected amount of time, in the example, the time is one (1) second. Next, at step 66 the processor 80 moves or copies the current paper out latch recorded at step 63 to the other of the first and second storage registers 81, 82 and records such as previous paper out latch. The current and previous paper out latches or flags are recorded at the first and second storage registers 81, 82 such that the controller 80 can compare the current paper out latch and the previous paper out latch. After the first cycle of the polling loop 60, the loop returns to the step 62 for a second polling of the sensor 50. At step 62, the sensor 50 reads the media and the reading is recorded according to the rules set forth at step 63. Next, at step 64, the controller 80 compares the current paper out latch with the previous paper out latch of the first cycle through loop 60. In any event, according to the present embodiment, the controller 80 is looking for indication of missing media. In the illustrative example, if the current paper out latch is equal to 0 (media present) and the previous paper out latch is equal to 1 (paper out), then the controller 80 determines that the media tray 22 has been replenished and sets a paper change latch to 1. The paper change latch may be stored in a storage register at a location accessible by the controller 80. This may be within storage registers 81, 82 or in other storage registers either on-board the controller 80 or remotely accessible by the controller 80. As previously described, the controller 80 waits a preselected period of time at step 65. Next, the controller 80 copies the current paper out latch to the previous paper out latch at step 66 and cycles again. The loop 60 runs concurrently with a second loop 70, the printer operation and display loop. Loop 70 analyzes at least one output of loop 60 and determines the appropriate display for device 10 discussed further herein.

As the media sensor polling loop 60 continues to operate, the loop 60 is ascertaining a current paper out latch value, moving that value to the previous paper out latch value, and comparing the current value to the previous value. As the loop 60 returns to polling of the sensor 50 at step 62, the second reading of the sensor 50 is recorded at step 64 as some current media-type or alternatively labeling a current paper out latch as one (1) or zero (0) and previous paper out latch as one (1) or zero (0), for example. As the previous media-type register at one of the first and second storage registers 81, 82 is continuously filled and the current media-type register at one of the first and second storage registers 81, 82 is filled, the controller 80 may compare the register values to ascertain the condition of the media tray 22. By comparing the current value response from sensor 50 to the previous value response of sensor 50, the controller 80 may determine whether media is present. For example, if the current paper out latch value is recorded as one of, for example, plain media, transparency or photo media and the previous media-type is recorded as paper out then the controller 80 can ascertain that media has been loaded into the tray 22. Alternatively, if the previous media-type is recorded as one of, for example, plain media, transparency or photo media, and the subsequent current media-type is recorded as empty or paper out, then the controller 80 can ascertain that the media tray 22 has just emptied.

Moving from the media sensor polling loop 60, the concurrently operating loop 70 evaluates the determinations of the sensor polling loop 60 and creates a proper display for the user at display 34. The controller 80 ascertains an appropriate display based on whether the printer is idle and whether the media tray is empty or not. In the operation of loop 70, the controller 80 first determines whether the printer 20 is idle at step 72. Accordingly, if the printer 20 is not idle, then the loop 70 ascertains whether the printer 20 is printing a job at step 74. The printer 20 will most likely be printing when it is not idle, but such step 74 may be necessary due to, for example, printer power up, power down and also when the printer is in a locked condition, such as when a host computer has the device 10 locked from scanning or copying. If the printer 20 is not printing a job at step 74, the decision loop determines to continue normally at step 76. If the printer 20 is printing, the controller 80 next ascertains whether the current paper out latch is equal to one (1) (paper empty) at step 78. If the controller 80 ascertains that the current paper out latch is not equal to one (1), meaning paper is present in the exemplary embodiment, the printer continues operating normally (step 76). Alternatively, if the controller 80 determines that the paper out latch is equal to one (1) (paper empty) it directs the display 34, to display a message, such as "Load Paper and Press Select" at step 83. Once the user loads media and the select button is pressed, the print job is continued at step 84 because the loop 60 will see the media and change the current paper out latch to zero (0) indicating media is present.

Referring back to step 72, if the controller 80 determines that the printer 20 is idle, the controller 80 next determines at 85 if the paper change latch is equal to one (1), meaning paper was re-filled in tray 22. If the paper change latch is not equal to one (1), the function continues normally at step 76. However, if the paper change latch is equal to one (1), again meaning media tray 22 has been replenished in the exemplary embodiment, the display 34 indicates that a paper change is detected at step 86. Next the controller 80 waits some preselected amount of time to allow the user to read the message. In the example, the time is 4 seconds. After such wait, the controller 80 displays the paper setup menu at step 87 and the user must enter media characteristics within the paper selection menus. Upon passing through the menu system and exiting, at step 88 the paper change latch is reset to zero (0) and the control panel display 34 displays the previous screen at step 89. At this point, the loop 70 can continue its cycle and return to step 72. Thus, as comparisons continue to be made between previous and current data in loop 60, the loop 70 continues to cycle to ascertain proper printer operation and display at control panel 30.

Figure 6:
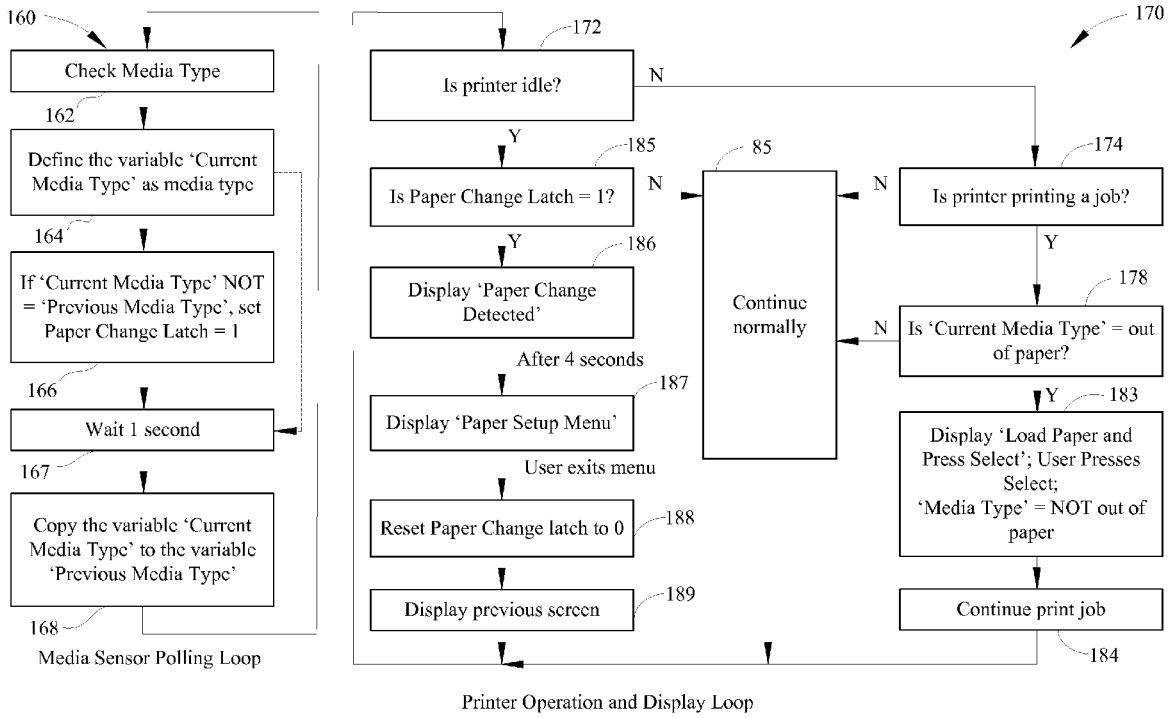
FIG. 6 is a flow chart of an alternative method of detecting a media change; and, FIG. 7 is a flow chart of yet a further alternative method of detecting a media change.

Referring now to FIG. 6, an alternative embodiment is depicted for use wherein the media sensor 50 may or may not necessarily indicate a media empty situation, but is generally utilized to detect a media-type change. For example, a user may place a transparency on top of a stack of plain media and the media sensor 50 may indicate such. According to this embodiment, a media-type polling loop 160 polls the sensor 50 for media-type at step 162. Next, the controller 80 records or defines a "current media-type" reading or variable from the sensor 50 as one of, for example, plain media, photo paper or transparency at step 164. The variable may be defined or recorded in one of the storage registers 81, 82. During an initial cycle in loop 160, the controller 80 bypasses step 166, as indicated by the broken line extending from step 164 to step 167. This is necessary since the controller 80 needs two values to compare at step 166, described further herein. Next at step 167, the controller 80 may wait some preselected period of time, in this exemplary embodiment the time may be one second, although such time period may vary. After waiting the preselected time period, the current media-type variable is copied to previous media-type in the other of the storage registers 81, 82. This action occurs at step 168. At this point, the storage registers 81, 82 have a current media-type and a previous media-type. Upon returning through the loop 160, the controller 80 polls the sensor 50 again for a value at step 162 and obtains a new current media-type value. At step 166, if the current media-type is not equal to the previous media-type, the paper change latch is set to some preselected digital value, in the example the value is set to 1. In this exemplary embodiment, the paper change latch being equal to one (1) indicates to the controller 80 that media-type has changed. A complementary printer operation and display loop 170 analyzes the paper change latch value for proper printer and display operation. Next the controller 80 waits a preselected period of time at step 167 and copies the current media-type to previous media-type at step 168, in preparation for an additional cycle through loop 160.

The printer operation and display loop 170 operates similarly to the loop 70 previously described. Steps 172, 174, 176 and 184-189 function similarly to their counterpart steps 72, 74, 76, and 84-89 described in FIG. 5. However, in loop 170, step 178 includes the determination of whether media-type is equal to a paper empty condition. Likewise, if the media-type is determined to be out of media at step 178, the controller 80 displays a message to Load Paper and Press Select at step 183. When the select button is pressed, the media-type is reset to not out of paper. As previously described, the loop 170 operates concurrently with loop 160 to analyze the results of the loop 160 and operate printer 20.

Figure 7:
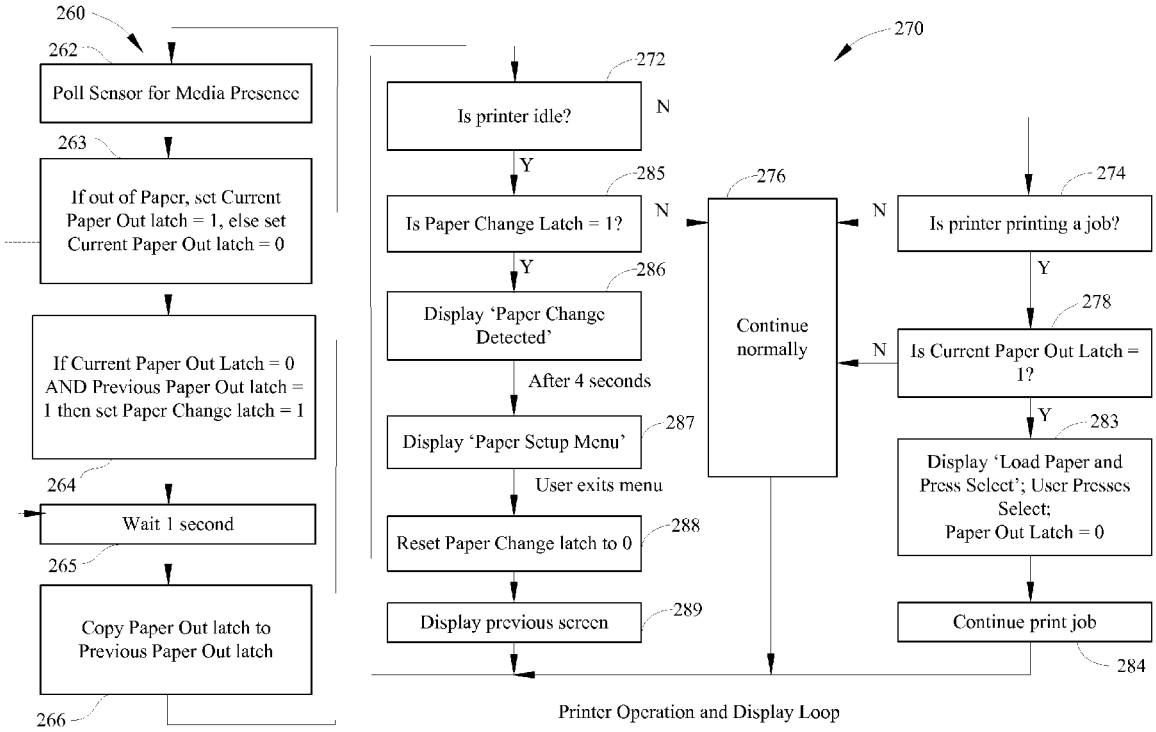

Referring now to FIG. 7, a flow chart depicts an alternative method for determining whether media is present and for further detecting a media change. In the present embodiment, the sensor 50 merely senses whether media is present and does not detect media-type as in the previous embodiments. Referring first to an out of media loop 260, the controller 80 first polls the sensor 50 for media presence at step 262. According to this example, the sensor 50 will determine that media is present or not present. If the sensor 50 determines the tray 22 is out of paper, a current paper out latch is set to equal one or some preselected digital representation at step 263. Otherwise, the current paper out latch is set to equal zero or some other preselected digital representation, not equal to the value defined when media is present. During an initial cycle, the controller 80 will bypass step 264, as previously described, since that step compares a previous value to a current value and two values are not available on the initial cycle through the loop 260. The bypass is indicated in broken line extending from the step 263 to step 265. At step 265, the controller waits some preselected period of time, in this illustrative instance one (1) second. Next, at step 266, the controller 80 copies the current paper out latch to a previous paper out latch. The current and previous paper out latches may be stored digital values located in one of the storage registers 81, 82 and the other of the storage registers 81, 82, respectively. After this first cycle through the loop 260, the controller 80 has at least a value for the previous paper out latch. Next, the loop 260 returns to step 262 and polls the sensor 50 for media presence. At step 263, the sensor 50 provides the controller with a value for the current paper out latch so that the controller 80 has a previous paper out latch value from the initial cycle and a current paper out latch from the second cycle. At step 264, the controller 80 compares the current paper out latch to the previous paper out latch. If the current paper out latch differs from the previous paper out latch, the paper change latch is set to a preselected value, at step 264. In the illustrative embodiment, if the current paper or media out latch is equal to zero (0) and the previous paper out latch is set to one (1), then the paper change latch is set to one (1). Once the paper change latch is set to one (1), this signals the controller that a media change has occurred.

The adjacent printer operation loop 270 utilizes this information to properly display and prompt a user to operate or load media. Loop 270 operates similarly to the previously described loops 70,170. Steps 272, 274, 276 and 284-289 function similarly to their counterpart steps 72, 74, 76, and 84-89 described in FIG. 5. In this case, the loop 270, which may be found in firmware of the controller 80, analyzes for the paper change latch to equal some preselected value, in this example one (1) or the current paper out latch to equal some preselected value, in this example one (1). When these situations occur, the controller 80 will either signal that a paper change is detected and prompt the user to move through a menu on display 34 or will direct the user to load paper. Once such action is performed, the user resets the paper change latch or the paper out latch and the loop 270 recycles.

The foregoing description of several methods and embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A method of paper change detection comprising:
querying a media sensor a first time;
defining a first current media condition;
defining said first current media condition as a previous media condition;
querying said media sensor a second time;
defining a second current media condition;
comparing said previous media condition to said second current media condition;
detecting a media change when said previous media condition is empty and said second current media condition is not empty; and,
prompting a user to make appropriate menu selections when said media change is detected.

2. The method of claim 1 further comprising said detecting said media change in a first media polling loop and said prompting said user in a second printer operation and display loop.

3. The method of claim 1 further comprising setting a current paper out latch or a previous paper out latch for said current media condition and said previous media condition.

4. The method of claim 1 further comprising moving through a menu to reset said media conditions when said media is detected to be empty or said media is detected to have changed.

5. The method of claim 1, said sensor detecting at least one of media-type and paper out condition.

6. A method of media change detection comprising:
querying a media sensor for media-type;
defining a first current media-type;
defining said first current media-type as a previous media-type;
querying said media sensor for a second current media-type;
defining a second current media-type;
comparing said second current media-type to said previous media-type;
detecting a media-type change when said previous media-type differs from said second current media-type; and,
prompting a user to make at least one appropriate menu selection regarding said media-type change.

7. The method of claim 6, said media sensor detecting at least one of media-type and media out condition.

8. The method of claim 6 further determining whether a printer is idle.

9. The method of claim 8 further comprising displaying a load media message when said media sensor detects no media-type is present.

10. The method of claim 9 further comprising making at least one selection when additional media is loaded.

11. A method of detecting media change along a media feedpath of a peripheral comprising:
querying a media sensor for a first media-type;
querying said media sensor a second time for a second media-type;
determining whether said first media-type differs from said second media-type; and, prompting a user to make at least one selection when said second media-type changes from said first media-type.

12. The method of claim 11 wherein said media sensor detects multiple types of media present.

13. The method of claim 12 further comprising displaying a media change detection on a menu.

14. The method of claim 13 further comprising directing a user to verify said media change after being prompted.

15. The method of claim 11 wherein said media sensor detects media empty condition.

16. The method of claim 15 further comprising directing a user to load media when a tray in said peripheral is empty.

17. The method of claim 11 wherein said first media-type is media empty and said second media-type indicates media present.

18. The method of claim 11 wherein said first media-type indicates media present and said second media-type indicates media empty.

19. The method of claim 11 further comprising querying said media sensor repeatedly while said peripheral is powered on.

* * * * *